US005611582A

United States Patent [19]

Frolov et al.

[11] Patent Number: 5,611,582

[45] Date of Patent: Mar. 18, 1997

[54] IMPACT RESISTANT ARMATURE

[75] Inventors: George Frolov, Farmington; John E. Walsh, III, Bristol; James C. Wobbles, Middlebury, all of Conn.

[73] Assignee: Harrow Products, Inc., Grand Rapids, Mich.

[21] Appl. No.: 623,367

[22] Filed: Mar. 28, 1996

[51] Int. Cl.[6] ..... E05C 17/56

[52] U.S. Cl. ..... 292/251.5

[58] Field of Search ..... 292/251.5, 144

[56] References Cited

U.S. PATENT DOCUMENTS

| | | | |
|---|---|---|---|
| 2,801,870 | 8/1957 | Davey | 292/251.5 |
| 4,957,316 | 9/1990 | Frolov | 292/251.5 |
| 4,986,581 | 1/1991 | Geringer et al. | 292/251.5 |
| 5,016,929 | 5/1991 | Frolov | 292/251.5 |
| 5,065,136 | 11/1991 | Frolov et al. | 292/251.5 X |

*Primary Examiner*—Rodney M. Lindsey

*Attorney, Agent, or Firm*—Chilton, Alix & Van Kirk

[57] ABSTRACT

An impact resistant armature has an armature plate defining a stepped bore therethrough. The stepped bore defines a shoulder. A mounting assembly having an expanded head portion and a reduced shank portion is positioned in the bore, with the shank portion anchored to the vertical face of a door. The mounting assembly supports the armature assembly in a first position wherein the head portion and the shoulder define an initial gap. Upon impact by an intense force, the armature plate is movable to a second position wherein the head portion and the shoulder engage while the armature retains a bonded relationship with the electromagnet.

15 Claims, 5 Drawing Sheets

IMPACT RESISTANT ARMATURE

BACKGROUND OF THE INVENTION

This invention relates to the field of electromagnetic door security systems. More specifically, this invention relates to an armature adapted for attractive engagement to the electromagnet of an electromagnetic door security system.

Electromagnetic door security systems are well known for controlling access to secured areas. These door security systems have proven to be safe and reliable in securing a door and also allowing failsafe egress in an emergency situation. Electromagnetic door security systems typically employ an electromagnet fixed to the door frame and an armature mounted to the door for attractive engagement to the electromagnet. The attractive engagement generates a substantial magnetic locking force to resist opening of the door. Electromagnetic door security systems have proven to be generally resistant to forced entry, In particular, these systems are resistant to large static forces applied to the door.

However, in some operational environments and under certain extreme conditions, the bonding engagement of the armature and the electromagnet may be susceptible to unauthorized destruction. More specifically, it has been found that in some public environments having secured gates and fire doors, unauthorized personnel can generate momentary high peak dynamic forces against the secured gates and doors. These high peak forces may be sufficient to overcome the attractive engagement of the electromagnet and armature and defeat the door security system. Such momentary peak forces are typically generated by forceful kicks or other methods of battering against the door or gate. These brief but high intensity peak forces, or spikes, can momentarily overcome the attractive engagement of the armature to the electromagnet and therefore allow the door to swing open.

The problem can be particularly exacerbated by the solid doors and heavy gates typically employed in public facilities. These solid doors and gates are rigid and thus exhibit little flexion, and consequently a substantial portion of the peak force from a kick or battering is efficiently transmitted to the door security system. To overcome the potential deficiency in conventional electromagnetic door security systems, multiple electromagnets have been employed to increase the locking force on a particular door. However, the requirement for additional electromagnets and armatures can substantially increase the initial purchase and installation costs for a security system.

SUMMARY OF THE INVENTION

Briefly stated, the invention is an impact resistant armature for attractive engagement to the electromagnet of a door security system. The impact resistant armature includes an armature plate mounted to the vertical face of a door opposite an electromagnet. The armature plate defines an attractive face for engagement to the electromagnet and a rear face opposite the attractive face. A stepped bore extends through the armature to define an impact shoulder between the attractive face and the rear face. A mounting assembly having an expanded head portion engageable to the shoulder of the stepped bore is positioned within the bore. Extending from the head portion of the mounting assembly is a reduced shank portion. The shank portion of the mounting assembly passes through the rear face of the armature plate and is anchored to the door.

The armature is movable on the mounting assembly from a first position wherein the expanded head portion of the mounting assembly and the shoulder of the armature plate define an initial gap, to a second position wherein the expanded head portion and the shoulder engage. A flat spring supported against the door by the mounting assembly biases the armature plate toward the first position to maintain the initial gap.

In operation, the door is secured by magnetic bonding of the armature plate to the electromagnet. The armature spring maintains the initial gap between the expanded head portion of the mounting assembly and the impact shoulder of the stepped bore. When a large peak force is exerted on the door by a kick or other form of battering, the force is transmitted through the door to the mounting assembly. The peak force overcomes the resilient force of the spring, and the door and mounting assembly move relative to the door frame, electromagnet and armature. The flat spring flexes to absorb a portion of the peak force. The absorption of a portion of the force by the spring reduces the magnitude of the force on the electromagnet armature interface. The expanded head portion of the mounting assembly moves to engage against the impact shoulder, thereby transmitting a reduced force to the armature plate and therefore the electromagnet. The reduced force is less likely to disengage the armature from the electromagnet, therefore providing an additional level of security over a conventional electromagnetic door security system having a conventional armature.

An object of the invention is to provide an armature for an electromagnetic lock that reduces peak forces on the electromagnet armature interface.

Another object of the invention is to provide an electromagnetic door lock system which is highly resistant to kicks and other battering forces.

A still another object of the invention to provide a cost effective impact resistant armature that does not require substantial additional installation time.

A yet another object of the invention to provide an impact resistant armature having a low profile.

These and other objects of the invention will become apparent from the following description and figures.

DETAILED DESCRIPTION OF THE PREFERRED EMBODIMENT

Figure 1:
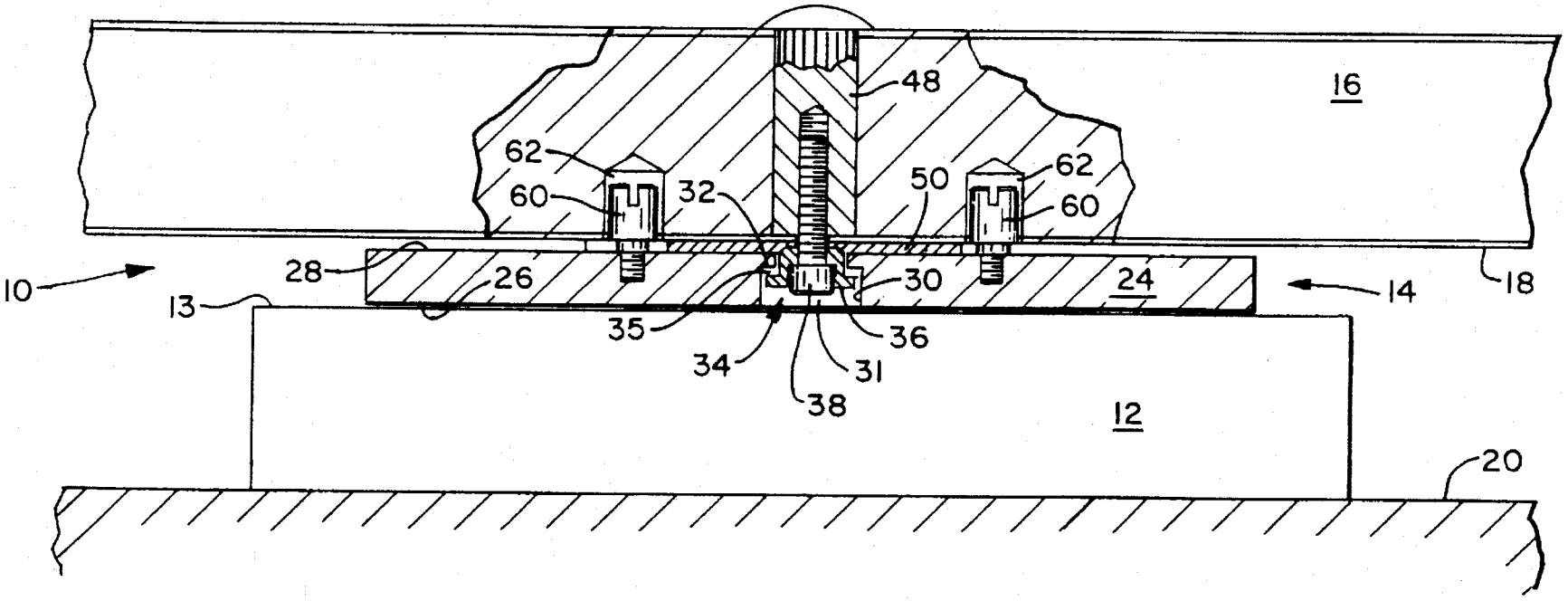
FIG. 1 is a fragmentary sectional view, partly broken away, of an electromagnetic door security system installed in conjunction with a door and associated door frame, the door security system employing the impact resistant armature of the invention.

With reference to the drawings wherein like numerals represent like components throughout the figures, an electromagnetic door system which incorporates an impact resistant armature in accordance with the invention is generally designated by the numeral 10. The door security system 10 secures a door or gate 16 supported by a frame 20. The invention will be described in terms of a door 16, but the invention also has applicability in conjunction with a gate (not illustrated) or other barrier (not illustrated) which swings and which selectively secures an area. The door 16 has a door vertical face 18 that is generally perpendicular to the floor throughout the swing or pivotal travel of the door. The door 16 functions as a selectively positionable door or a gate for forming a barrier across the entranceway defined by the frame 20. The door security system 10 has an electromagnet 12 and an armature assembly 14 for securing the door. The electromagnetic 12 is mounted in a fixed position relative to the door frame 20.

Figure 7:
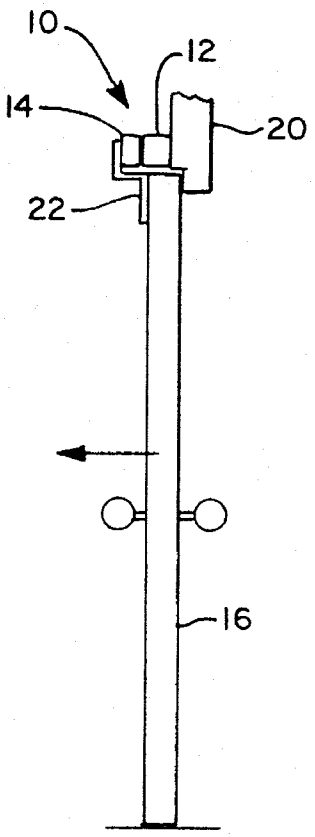
FIG. 7 is a side elevational view, partly in schematic, of an alternate mounting arrangement of the door security system, door and door frame of FIG. 1.
Figure 6:
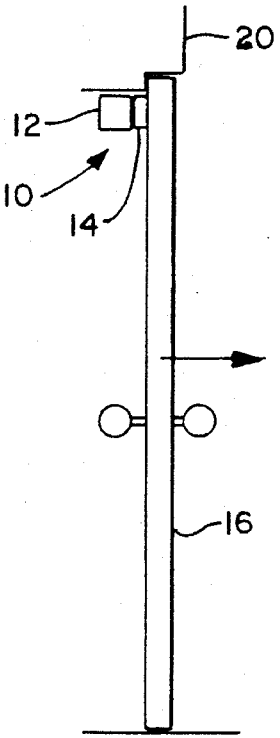
FIG. 6 is a side elevational view, partly in schematic, of the door security system, door and door frame of FIG. 1.

In the preferred embodiment, the electromagnet 12 defines a bonding face 13 oriented toward the vertical face 18 of the door 16. The armature assembly 14 is anchored on the vertical face of the door 16 in opposite relation to the electromagnet and defines an attractive face 26 positioned opposite the bonding face 13 of the electromagnet 12. Typically, the armature assembly 14 attractively engages to the electromagnet 12 to prevent the door 16 from swinging outward. (See FIG. 6.) In an alternative installation, the bonding face 13 of the electromagnet 12 is oriented away from the door 16, and the armature assembly 14 is anchored to an armature bracket 22 affixed to the door 16. The armature assembly is arranged in a position generally parallel with the vertical door face 18 of the door 16 and attractively engages to the electromagnet 12 to prevent the door 16 from swinging inward. (See FIG. 7.)

The armature assembly 14 has an elongated armature plate 24 for electromagnetic bonding to the electromagnet 12. The armature plate 24 has a rear face 28 oppositely disposed from the attractive face 26 of the armature plate 24. The armature plate 24 defines a central stepped bore 30 generally perpendicular to the attractive face 26 and preferably circular for simplified manufacture. The stepped bore 30 forms a continuous opening through the armature plate from the attractive face 26 to the rear face 28. The stepped bore 30 has an enlarged portion 31 positioned nearer the attractive face 26 and a reduced portion 33 nearer the rear face 28. The stepped bore 30 defines an impact shoulder 32 at the enlarged/reduced portion interface between the attractive face 26 and the rear face 28.

Figure 4:
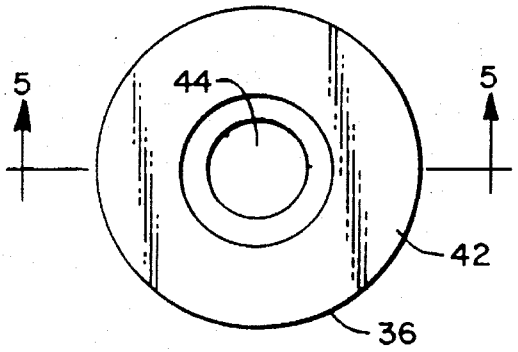
FIG. 4 is an enlarged top view, partially in phantom, of a mounting assembly collar of the impact resistant armature of FIG. 1.
Figure 5:
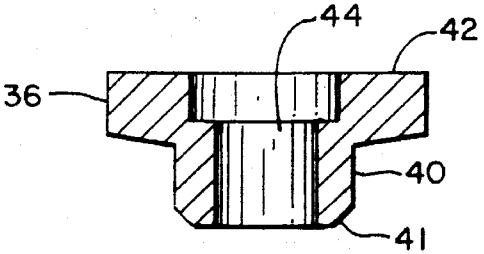
FIG. 5 is a cross-sectional view of the collar of FIG. 4 taken along the line 5—5 thereof.

A mounting assembly 34 is positioned within the stepped bore 30. The mounting assembly 34 includes a mounting collar 36 and a mounting bolt 38 which passes through the mounting collar 36. The collar 36 has an annular collar body 40 with a radially extending flange 42. (See FIGS. 4 and 5.) The bottom edge 41 of the collar body 40 is preferably beveled. The collar body 40 is dimensioned for reception in the reduced portion 33 of the stepped bore 30. The flange 42 is engageable with the shoulder 32 to prevent the collar 26 from passing entirely through the stepped bore 30. The mounting bolt 38 is a conventional bolt having an expanded head portion and a threaded shank. The collar 36 further defines a bolt opening 44 for the passage of the shank portion of the mounting bolt 38 therethrough. The shank extends beyond the rear face 28 of the armature plate 24 and is anchored to the door 16. The mounting bolt 38 preferably rotatably threadably engages to a blind nut 48 extending through the door 16. Alternately, the bolt can threadably engage to the door directly or be bolted or welded to a portion of the door structure.

Preferably a single mounting assembly 34 and a single stepped bore 30 are located in the central portion of the armature plate 24 to allow small rocking motions of the armature to enhance the surface-to-surface engagement between the armature plate 24 and the electromagnet 12. Furthermore, a single mounting assembly allows for a relatively efficient installation of the armature assembly 14.

Figure 2:
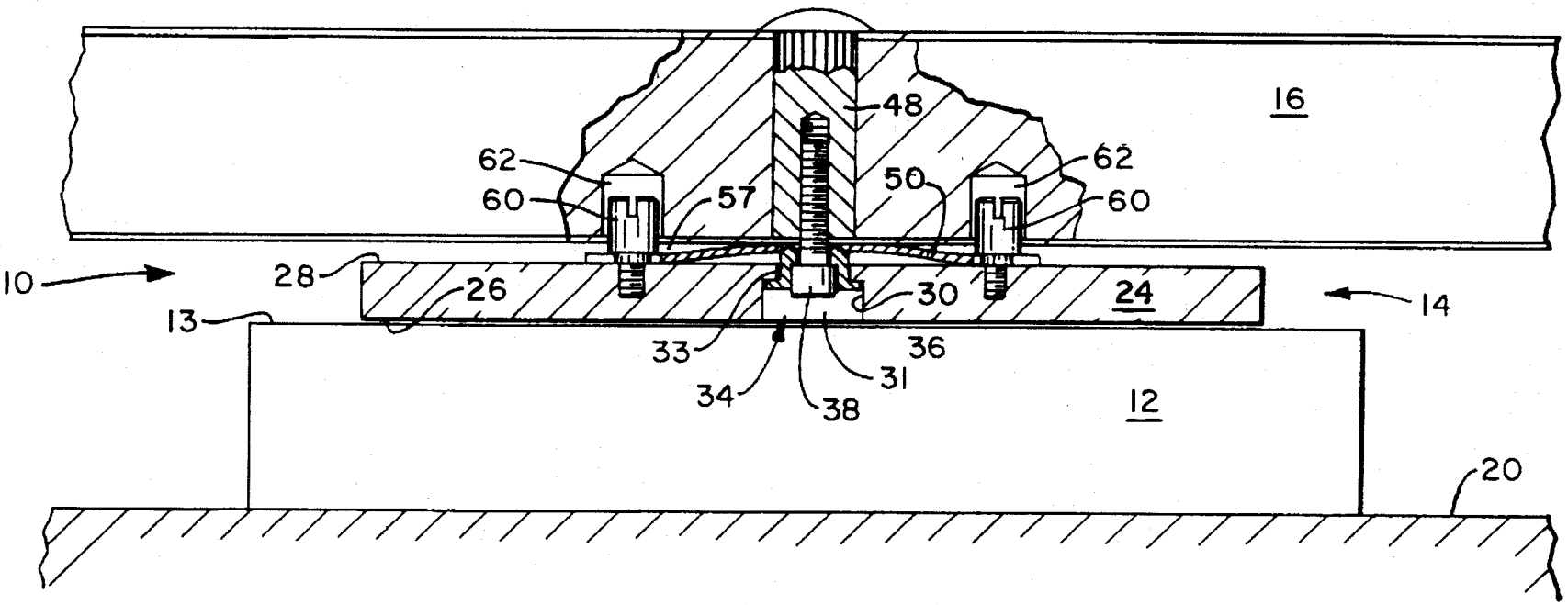
FIG. 2 is a fragmentary sectional view, partly broken away, of the door security system, door and door frame of FIG. 1 illustrating the impact of a spike force against the door.
Figure 3:
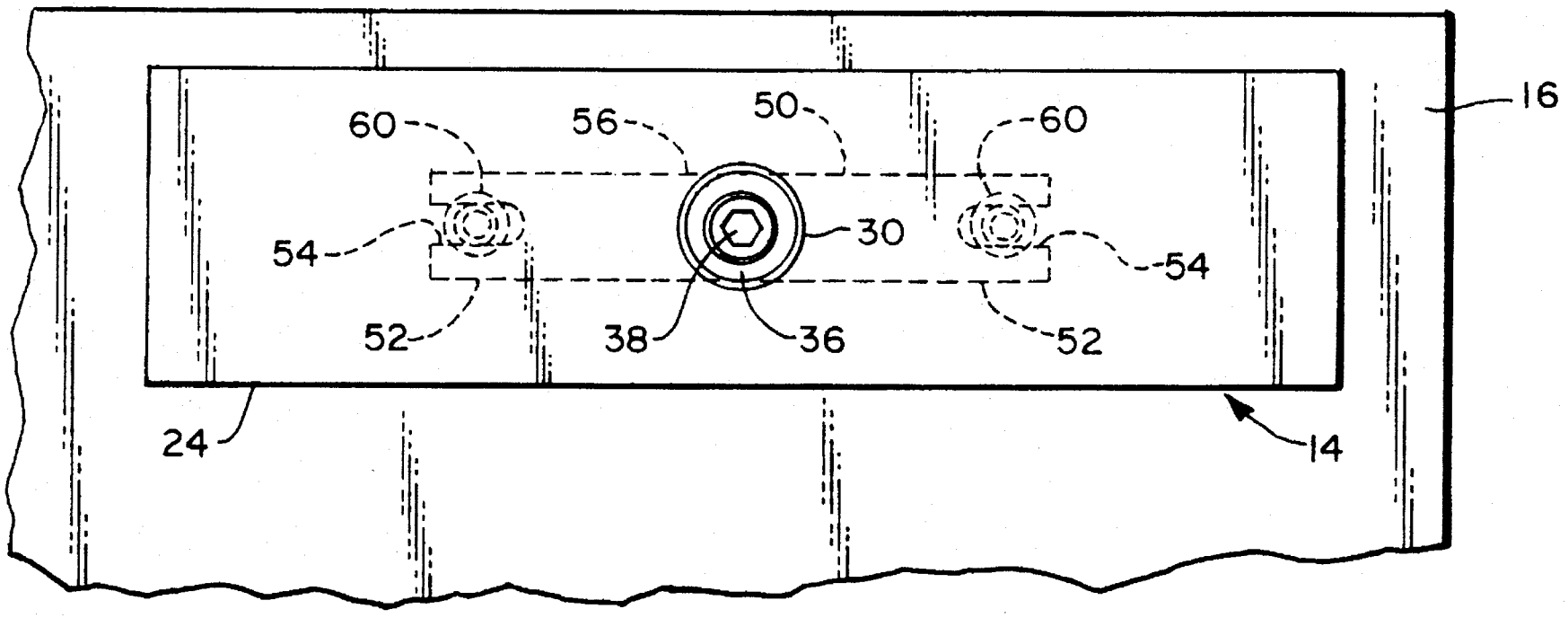
FIG. 3 is a front view, partially in phantom, of the impact resistant armature of the door security system and the door of FIG. 1
Figure 8:
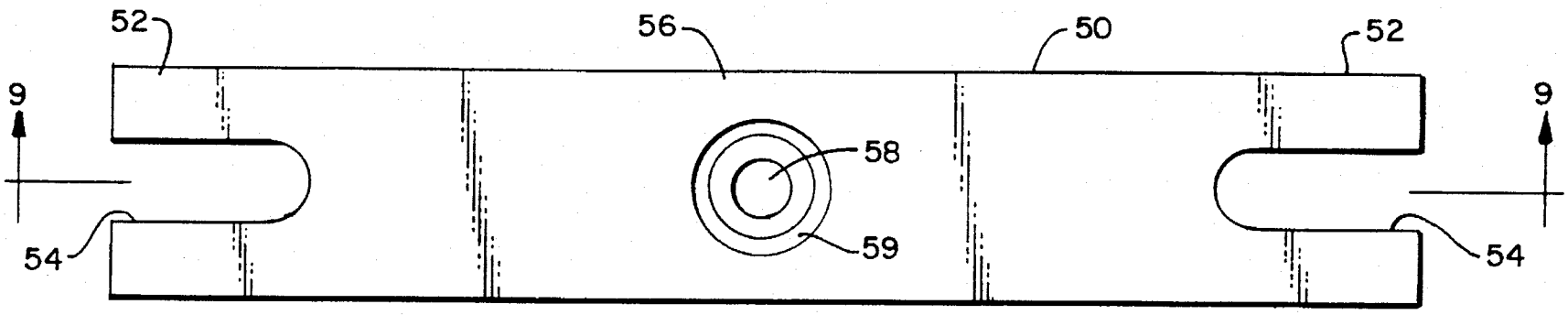
FIG. 8 is an enlarged top view of a spring of the impact resistant armature of the door security system of FIG. 1.
Figure 9:
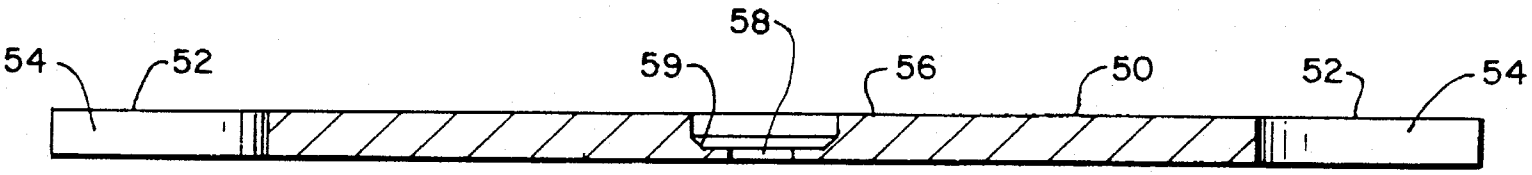
FIG. 9 is an enlarged cross-sectional view of the spring of FIG. 8 taken along the line 9—9 thereof and exaggerated to illustrate detail.

A flat spring 50 is interposed between the armature plate 24 and door 16. The flat spring 50 has end portions 52 defining end openings 54. Positioned between the end portions 52 is an intermediate spring portion 56 having a central mounting opening 58 to allow passage of the mounting assembly 34 therethrough. The flat spring 50 forms an annular seat 59 at the mounting opening 58. (See FIGS. 8–9.) The intermediate spring portion 56 is held in tight engagement with the door 16 by the mounting bolt 38 holding the bottom edge 41 of the mounting collar 36 against the seat 59 of the flat spring 50. (See FIGS. 1 and 2.)

The flat spring 50 in combination with the mounting assembly 34 and armature plate 24 result in a low profile armature assembly 14. Therefore, the armature assembly 14 is readily compatible with conventional electromagnetic locks and can be retrofitted to existing door lock systems without significant additional expense.

Guide pins 60 extend through the end openings 54 of the spring 50 and are fixed through the rear face to the armature plate 24. The guide pins 60 define an annular shoulder having a diameter greater than the end openings 54. The pin shoulders limit to a minimal distance motion of the spring end portions 52 away from the armature plate 24. Therefore, the spring end portions are generally fixed in the transverse direction relative to the armature plate. However, the spring end portions are permitted to move longitudinally relative to the armature plate to allow the flat spring 50 to flex. Alternate spring retaining structures (not illustrated) that prevent transverse motion, but not longitudinal motion of the end portions, such as a strap across the end portion of the spring and fixed to the rear face 28 of the armature plate 24 or the end portions of a spring directly engaging the armature plate, can also be employed. The guide pins 60 preferably additionally extend through guide bores 62 in the door 16 to prevent rotation of the armature plate 29 around the mounting assembly 34.

In operation, the armature plate 24 is electromagnetically engaged to the electromagnet 12 to provide securement of the door 16. The armature plate has a first position wherein the flange 42 of the mounting collar 36 and the impact shoulder 32 of the armature plate 24 define an initial gap 35 therebetween. (See FIG. 1) The flat spring 50 biases the armature plate 24 toward the first position to maintain the initial gap. When a force greater than the resilient force of the spring 50, such as a kick or a battering, is applied to the door, the flat spring 50 flexes. The door and mounting assembly move to a second position as the spring flexes wherein the flange 42 and impact shoulder 32 engage to prevent further transverse motion of the armature plate 24 relative to the door 16. (See FIG. 2.)

In the second position, the intermediate portion 56 of the flat spring 50 is maintained against the door 16 by the mounting assembly 34. The end portions 52 of the spring 50 engage against the shoulders of the guide pins 60 to flex the flat spring 50 and create a spring gap 57 between the door 16 and the flat spring 50. The spring gap 57 is generally equal to the initial gap 35. On removal of the force against the door 16, the flat spring 50 acts against the shoulders of the guide pins 60 to move the armature plate 24 transversely and reestablish the initial gap 35.

The flexing of the flat spring 50 substantially reduces the spike or peak force transmitted to the armature plate 24 and therefore to the interface of the attractive face 26 of the armature plate 24 and the bonding face 13 of the electromagoet 12. The peak force reduction prevents disengagement of the armature plate 24 from the electromagnet 12 and therefore maintains the bonding integrity of the electromagnetic lock under intense forces.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. An armature assembly for an electromagnetic door lock, said armature assembly comprising:

an armature plate having an attractive face for attractive engagement to an electromagnet and an opposite rear face, said armature plate defining a stepped mounting bore through said rear face, said mounting bore defining an impact shoulder between said attractive face and said rear face;

a mounting assembly having an expanded head portion locatable in said bore, said head portion engageable against said shoulder and a reduced shank portion extending from said head portion, said shank portion extendable through said rear face;

anchor means for anchoring said shank portion to a door;

a spring having first and second spring end portions, each said spring end portion defining a spring end opening, said spring end openings having a diameter, said spring further defining a spring intermediate portion between said spring end portions, said shank portion extendable through an opening in said spring intermediate portion to support said spring against said door;

pin means at each said spring end opening for mounting said spring ends to said armature plate, each said pin means comprising a head having a greater diameter than the diameter of said corresponding spring end opening and a reduced pin shank portion extending from said pin head through said spring end opening and fixed to said armature plate at said rear face, said armature plate being supportable in a first position wherein said impact shoulder and said head portion define an initial gap, said armature plate further being movable to a second position wherein said mounting assembly head portion engages said impact shoulder, said spring biasing said armature plate to said first position.

2. The armature assembly of claim 1 wherein said anchor means comprises a blind nut threadably engageable to said shank portion of said mounting assembly.

3. The armature assembly of claim 1 wherein said pin means are extendable into said door.

4. The armature assembly of claim 1 wherein said mounting assembly comprises a bolt and a circular collar around said bolt.

5. The armature assembly of claim 1 wherein said spring means comprises a flat spring.

6. The armature assembly of claim 1 wherein said head portion engages said shoulder along a generally annular interface.

7. An armature assembly for an electromagnetic lock comprising:

a door defining a generally vertical face;

an armature plate having an attractive face generally parallel to said vertical face and a rear face opposite said attractive face, said armature plate defining a stepped bore through said rear face, said bore defining an impact shoulder;

a mounting assembly having an expanded head portion to retain the armature plate to the door and a reduced shank portion, said head portion positioned in said stepped bore and engageable against said impact shoulder, said shank portion extending through said rear face;

anchor means for anchoring said shank portion to said door; and spring means engaged by said shank portion for biasing said armature plate to a first position, said armature plate in said first position wherein said head portion and said impact shoulder define an initial gap and said armature plate being movable to a second position wherein said expanded head portion engages said impact shoulder.

8. The armature assembly of claim 7 wherein said spring means comprises an elongated flat spring.

9. The armature assembly of claim 7 wherein said spring means is captured between said armature plate and said door and retained by said mounting assembly.

10. The armature assembly of claim 7 wherein said mounting assembly comprises a collar having a body and an annular flange extending from said body, and a bolt extending through said collar.

11. The armature assembly of claim 10 further comprising pin means for limiting the rotation of said armature plate about said bolt.

12. The armature assembly of claim 11 wherein said pin means partially extends into said door.

13. The armature assembly of claim 7 wherein said expanded head portion engages said impact shoulder along a generally annular interface.

14. The armature assembly of claim 7 wherein said spring means comprises an elongated spring and further comprising a pair of longitudinally spaced pins which limit the rotation of said spring, said pins having heads which retainably engage opposed end portions of said spring.

15. An armature assembly for an electromagnetic lock, said armature assembly comprising:

a door;

an armature plate, said armature plate having an attractive face for engagement to an electromagnet and a rear face opposite said attractive face, said armature plate defining a stepped bore through said armature plate, said bore defining an impact shoulder;

a stepped collar having a collar body and a collar flange extending from said collar body, said collar flange engageable against said bore shoulder, said collar positioned in said bore;

spring means comprising an elongated spring having first and second ends, each of said ends defining a spring end opening and said spring defining an intermediate opening disposed between said end openings;

pins extending through said spring end openings and fixed to said armature plate;

a bolt extending through said collar and said intermediate opening; and anchor means for anchoring said bolt to said door wherein said armature spring is fixed between said collar and said door and said armature plate has a first position wherein said impact shoulder and said collar flange define an initial gap, and said armature plate is movable to a second position wherein said impact shoulder and said flange engage, said spring means biasing said armature to said first position.

* * * * *